US010132576B2

(12) United States Patent
Friedl et al.

(10) Patent No.: US 10,132,576 B2
(45) Date of Patent: Nov. 20, 2018

(54) METHOD FOR OPERATING A HEAT EXCHANGER USING TEMPERATURE MEASUREMENTS TO DETERMINE SATURATION LEVEL

(71) Applicant: BELIMO HOLDING AG, Hinwil (CH)

(72) Inventors: Markus Friedl, Zurich (CH); Marc Thuillard, Uetikon am See (CH)

(73) Assignee: BELIMO HOLDING AG, Hinwil (CH)

( * ) Notice: Subject to any disclaimer, the term of this patent is extended or adjusted under 35 U.S.C. 154(b) by 0 days.

(21) Appl. No.: 15/960,891

(22) Filed: Apr. 24, 2018

(65) Prior Publication Data

US 2018/0238645 A1 Aug. 23, 2018

Related U.S. Application Data

(63) Continuation of application No. 14/407,478, filed as application No. PCT/EP2013/001934 on Jul. 2, 2013, now Pat. No. 9,982,955.

(30) Foreign Application Priority Data

Jul. 9, 2012 (CH) ..... 1058/12

(51) Int. Cl.
*G05D 23/00* (2006.01)
*F28F 27/00* (2006.01)
(Continued)

(52) U.S. Cl.
CPC ..... *F28F 27/00* (2013.01); *F24F 11/83* (2018.01); *F24F 11/30* (2018.01); *F24F 11/84* (2018.01);
(Continued)

(58) Field of Classification Search
CPC .... F24F 11/83; F24F 2140/20; F24F 2110/10; F24F 11/84; F24F 11/30; F28F 27/00
See application file for complete search history.

(56) References Cited

U.S. PATENT DOCUMENTS 4,034,570 A * 7/1977 Anderson ..... F25B 49/02 62/158
4,390,058 A * 6/1983 Otake ..... F28G 1/12 165/11.1
(Continued)

FOREIGN PATENT DOCUMENTS

CN 102483250 A 5/2012
EP 0 035 085 A1 9/1981

OTHER PUBLICATIONS

International Search Report of PCT/EP2013/001934 dated Sep. 13, 2013 [PCT/ISA/210].
(Continued)

*Primary Examiner* — Ljiljana Ciric
(74) *Attorney, Agent, or Firm* — Sughrue Mion, PLLC

(57) ABSTRACT

A method for operating a heat exchanger, through which a heat transfer medium flows on a primary side, entering the heat exchanger with a first temperature and exiting the heat exchanger with a second temperature. The heat transfer medium emits on a secondary side a heat flow to a secondary medium flowing through the heat exchanger in the case of heating or, in the case of cooling, absorbs a heat flow from the secondary medium which enters the heat exchanger with a third temperature and exits the heat exchanger again with a fourth temperature. The heat exchanger is capable of transferring a maximum heat flow. At least three of the four temperatures are measured and the respective saturation level of the heat exchanger is determined from these measured temperatures and is used for controlling the operation of the heat exchanger.

8 Claims, 6 Drawing Sheets

(51) Int. Cl.

| | |
|---|---|
| ***F24F 11/83*** | (2018.01) |
| *F24F 11/30* | (2018.01) |
| *F24F 140/20* | (2018.01) |
| *F24F 11/84* | (2018.01) |
| *F24F 110/10* | (2018.01) |

(52) U.S. Cl.
CPC ..... *F24F 2110/10* (2018.01); *F24F 2140/20* (2018.01)

(56) References Cited

U.S. PATENT DOCUMENTS 4,729,667 A * 3/1988 Blangetti ..... G01N 25/18 165/11.1
4,762,168 A * 8/1988 Kawabe ..... F28B 11/00 165/11.1
4,766,553 A * 8/1988 Kaya ..... F22B 37/56 165/11.1
5,353,653 A * 10/1994 Watanabe ..... F22D 1/325 165/11.1
5,385,202 A * 1/1995 Drosdziok ..... F28B 11/00 165/11.1
5,615,733 A * 4/1997 Yang ..... F28F 19/00 165/11.1
5,992,505 A * 11/1999 Moon ..... F28F 27/00 165/11.1
6,241,383 B1 * 6/2001 Feller ..... G01K 7/16 374/135
6,369,716 B1 * 4/2002 Abbas ..... G08B 21/12 340/632
6,931,352 B2 * 8/2005 Cryer ..... B60H 1/00792 702/130
7,110,906 B2 * 9/2006 Vesel ..... F28F 27/00 702/130
7,455,099 B2 * 11/2008 Osborn ..... F28F 19/00 165/11.1
7,685,830 B2 * 3/2010 Thybo ..... F25D 29/008 165/244
7,726,874 B2 * 6/2010 Kirchberg ..... F28F 27/00 374/147
8,100,167 B2 * 1/2012 Thybo ..... B60H 1/00978 165/11.1
8,774,978 B2 * 7/2014 Higgins ..... G06Q 10/06 700/295
8,943,847 B2 2/2015 Yamashita et al.
9,690,307 B2 * 6/2017 Kates ..... F24F 3/1603
9,982,955 B2 * 5/2018 Friedl ..... F24F 11/83
2003/0121271 A1 * 7/2003 Dinnage ..... F24F 3/1405 62/94
2005/0155362 A1 * 7/2005 Shah ..... F24F 11/0008 62/176.6
2006/0005554 A1 1/2006 Okada
2008/0041559 A1 2/2008 Woong et al.
2009/0090498 A1 * 4/2009 Okada ..... F28F 27/00 165/299
2011/0192172 A1 * 8/2011 Delacruz ..... F24F 1/42 62/3.2
2013/0178987 A1 * 7/2013 Meirav ..... F24F 11/0001 700/276
2014/0014311 A1 * 1/2014 Lach ..... F28F 27/00 165/200
2017/0329289 A1 * 11/2017 Kohn ..... G05B 13/0265

OTHER PUBLICATIONS

Communication dated Nov. 2, 2016, from the State Intellectual Property Office of the P.R.C., in counterpart Chinese application No. 201380036668.5.

* cited by examiner

METHOD FOR OPERATING A HEAT EXCHANGER USING TEMPERATURE MEASUREMENTS TO DETERMINE SATURATION LEVEL

CROSS REFERENCE TO RELATED APPLICATIONS

This is a Continuation of application Ser. No. 14/407,478 filed Dec. 12, 2014, claiming priority based on International Application No. PCT/EP2013/001934, filed Jul. 2, 2013, claiming priority based on Swiss Patent Application No. 01058/12, filed Jul. 9, 2012, the contents of all of which are incorporated herein by reference in their entirety.

TECHNICAL FIELD

The present invention refers to the field of air-conditioning technology. It relates to a method for operating a heat exchanger according to the preamble of claim 1. It relates further to a HVAC installation for implementing said method.

PRIOR ART

Central installations, collectively referred to as HVAC installations, are normally used for heating, cooling, air-conditioning and venting of rooms in buildings. HVAC stands for Heating, Ventilation and Air Conditioning. In such HVAC installations, heat and/or cold are/is generated centrally and are/is fed via a suitable heat transfer medium, in most cases water, to the respective premises where the heat and/or cold are/is emitted into the room air via local heat exchangers, for example.

The heat flow which is emitted or absorbed via the local heat exchanger and which is required for achieving a predetermined room temperature is often controlled in such a manner that the mass flow on the primary side of the heat transfer medium is changed accordingly. A section of an exemplary HVAC installation is illustrated in FIG. 1. The HVAC installation 10' of FIG. 1 comprises a local heat exchanger 15 that is connected on the primary side to a superordinated flow line 11 via a flow branch line 13 and via return branch line 14 to a superordinated return line 12. The flow line 11 and the return line 12 are connected to a central unit for heat and/or cold generation, which is not shown here. On the secondary side, an air flow 16 flows around the heat exchanger 15, which air flow absorbs heat in the case of heating or emits heat in the case of cooling. For adjusting the mass flow of the heat transfer medium through the primary side of the heat exchanger 15, a control valve 17 that is activated by a control 21 is arranged in the flow branch line 13 in the example of FIG. 1.

The heat flow emitted in the heat exchanger 15 to the air flow 16 is determined by the mass flow on the primary side of the heat transfer medium, the inlet temperature $T_{in}^{W}$ thereof at the inlet of the heat exchanger 15 and the outlet temperature $T_{out}^{W}$ thereof at the outlet of the heat exchanger 15 according to the simple relation $\dot{Q}=\dot{m}\cdot c_p\cdot(T_{in}^{W}-T_{out}^{W})$, with the mass flow $\dot{m}$ and the specific heat $c_p$ of the heat transfer medium. The mass flow is determined here via the corresponding volume flow $\dot{V}$, which is measured with a flowmeter 18 that is integrated in the return branch line 14, for example. Measuring the two temperatures $T_{in}^{W}$ and $T_{out}^{W}$ is carried out by means of two temperature sensors 19 and 20, which advantageously are arranged at the inlet and the outlet, respectively, on the primary side of the heat exchanger 15.

A comparable arrangement is known, for example, from the publication EP 0 035 085 A1, where said arrangement is used in connection with a consumption measurement. Moreover, in the room to be heated/air-conditioned, an additional temperature sensor is provided which controls the supply of the heat transfer medium on the primary side of the heat exchanger. If the room temperature sensor (RTS in FIG. 1) in this known arrangement signalizes increased heat requirement, the valve on the primary side of the heat exchanger is opened further (at constant flow temperature) in order to provide more heat.

The problem here is that the heat flow $\dot{Q}$ transferred via the heat exchanger shows a progression as a function of the volume flow $\dot{V}$ on the primary side, which is illustrated in FIG. 2. The progression of the curve—as will be explained below—depends, on the one hand, on the construction of the heat exchanger (in particular on the heat transfer surface A, the heat transition coefficient k, a factor F and an exponent n) and, on the other, on the temperature, the mass flow and the heat capacity of the medium on the secondary side of the heat exchanger.

The curve, which first steeply rises in the case of small volume flows, flattens more and more as the volume flow increases and approaches asymptotically a limit value $Q_{max}^{\&}$ (saturation). The flattening of the curve means that for the same increases in heat, greater increases in volume flow and therefore increasing pump capacity has to be provided. In particular, the capacity to be provided for the pump increases with the third power of the volume flow, whereas the transferred heat increases only insignificantly. However, this makes little sense from an economic point of view.

It is therefore desirable within such a control configuration to limit the volume flow when a predetermined value in the ratio $$\frac{Q^{\&}}{Q_{max}^{\&}},$$

which is the saturation level of the heat exchanger, is reached. Such a value can be selected to be 0.8, for example, as marked in FIG. 2. By introducing such a limit value, the pump capacity to be provided by the system can be limited without having to accept major losses of transferred heat quantity, which results in advantages in design and operation of the installation. On the other hand, it is also conceivable to change the air flow on the secondary side of the heat exchanger.

As already mentioned above, the current heat flow in the heat exchanger and therefore the point on the curve shown in FIG. 2 can be determined by measuring the volume flow and the temperatures on the primary side. For certain conditions on the secondary side of the heat exchanger, the curve and its asymptote can only be determined by the control 21 through measurements over an extended period of time. However, this requires a flowmeter which is relatively complex and can also be prone to faults if it contains movable parts.

For these reasons it would be advantageous to have a method by means of which the saturation level of the heat exchanger can be determined and monitored in a simplified manner.

SUMMARY OF THE INVENTION

It is therefore an object of the invention to configure a method for operating a heat exchanger of the aforementioned kind in such a manner that the use of a flowmeter is not required.

Furthermore, it is an object of the invention to propose an HVAC installation for implementing the method.

These and other objects are achieved by the features of claims 1 and 12.

The invention is based on a method for operating a heat exchanger through which a heat transfer medium flows on a primary side, which heat transfer medium enters the heat exchanger with a first temperature and exits the heat exchanger with a second temperature, and which emits on a secondary side a heat flow to a secondary medium flowing through the heat exchanger in the case of heating or, in the case of cooling, absorbs a heat flow from the secondary medium which enters the heat exchanger with a third temperature and exits the heat exchanger again with a fourth temperature, wherein the heat exchanger is capable of transferring a maximum heat flow.

The invention is characterized in that at least three of the four temperatures are measured and that the respective saturation level of the heat exchanger is determined from these measured temperatures and is used for controlling the operation of the heat exchanger.

One configuration of the method according to the invention is characterized in that the flow of the heat transfer medium on the primary side of the heat exchanger is controllable and that the flow of the heat transfer medium on the primary side of the heat exchanger is limited when the saturation level of the heat exchanger reaches a predetermined value.

Another configuration of the method according to the invention is characterized in that the flow of the secondary medium on the secondary side of the heat exchanger is controllable and that the saturation level of the heat exchanger is used for controlling the flow of the secondary medium.

It is principally possible, depending on application and demand, to use completely different media such as, e.g., water, ice, brine, ice slurry or similar media on both sides of the heat exchanger (primary side and secondary side).

In particular, however, the heat transfer medium can be water.

In particular, however, the secondary medium can be air.

Another configuration of the method according to the invention is characterized in that the heat exchanger is part of an HVAC installation.

According to another configuration of the invention, the first, second and third or fourth temperatures are measured, and a function of the kind $$\frac{\dot{Q}}{\dot{Q}_{max}} = f(T1, T2, T3) \text{ or } \frac{\dot{Q}}{\dot{Q}_{max}} = f(T_{in}^{W}, T_{out}^{W}, T_{in}^{L})$$

is used for determining the saturation level of the heat exchanger.

Within the scope of the invention, the heat exchanger can principally be operated in concurrent flow, cross-flow or counterflow or a combination of these types.

In particular, however, the heat exchanger is operated in counterflow and the function $$\frac{\dot{Q}}{\dot{Q}_{max}} = 1 - \frac{1}{2} \cdot \frac{T1 - T2}{T1 - T3} \text{ or } \frac{\dot{Q}}{\dot{Q}_{max}} = 1 - \frac{1}{2} \cdot \frac{T_{in}^{W} - T_{out}^{W}}{T_{in}^{W} - T_{in}^{L}}$$

is used for determining the saturation level of the heat exchanger.

However, it is also conceivable that the heat exchanger is operated in counterflow and that the function $$\frac{\dot{Q}}{\dot{Q}_{max}} = 1 - \frac{n}{2 \cdot (\Theta + n \cdot (1 - \Theta))} \cdot \frac{T1 - T2}{T1 - T3} \text{ or}$$

$$\frac{\dot{Q}}{\dot{Q}_{max}} = 1 - \frac{n}{2 \cdot (\Theta + n \cdot (1 - \Theta))} \cdot \frac{T_{in}^{W} - T_{out}^{W}}{T_{in}^{W} - T_{in}^{L}}$$

is used for determining the saturation level of the heat exchanger, wherein n designates a power that differs from the value 1, and σ is a constant that has in particular the value 0.7.

If the secondary medium is air, the moisture content of the air when entering the heat exchanger can additionally be measured in the case of cooling, wherein the saturation level of the heat exchanger determined from the temperatures is corrected accordingly so as to take account of a condensation taking place in the heat exchanger.

Another configuration of the method according to the invention is characterized in that the flow temperature of the heat exchanger is increased when the saturation level of the heat exchanger reaches a predetermined value.

The HVAC installation for implementing the method according to the invention comprises a heat exchanger which is connected on the primary side to a flow line and a return line of a central heating/cooling system that operates with a heat transfer medium and through which a secondary medium flows on the secondary side, and further comprises a control means for controlling the mass flow of the heat transfer medium on the primary side and/or for controlling the secondary flow, as well as a first temperature sensor for measuring the inlet temperature of the heat transfer medium entering the heat exchanger, a second temperature sensor for measuring the outlet temperature of the heat transfer medium exiting the heat exchanger, and a controller to which the first and second temperature sensors are connected on the inlet side, and which is connected on the outlet side to the control means.

The HVAC installation is characterized in that at least one third temperature sensor for measuring the inlet temperature and/or the outlet temperature of the secondary medium entering on the secondary side into the heat exchanger are/is provided, that the third temperature sensor is connected to an input of the controller and that the controller is designed such that it controls the control means in accordance with the temperature values measured by the at least three temperature sensors.

One configuration of the HVAC installation according to the invention is characterized in that a consumer is connected on the secondary side to the heat exchanger, and that the controller receives demand signals from the consumer via a demand signal line.

Another configuration of the HVAC installation according to the invention is characterized in that the heat transfer medium is water and the secondary medium is air.

Another configuration is characterized in that the control means is a control valve which is installed in a flow branch line or return branch line that leads to the primary side of the heat exchanger.

Another configuration is characterized in that the control means is a blower which is installed in an air duct that leads to the secondary side of the heat exchanger.

In particular, a humidity sensor for measuring the moisture content of the air flowing into the heat exchanger is provided, wherein the humidity sensor is connected to an input of the controller.

Another configuration of the HVAC installation according to the invention is characterized in that a flowmeter is provided which is installed in a flow branch line or return branch line that leads to the primary side of the heat exchanger, and that the flowmeter is connected to an input of the controller.

Yet another configuration of the HVAC installation according to the invention is characterized in that a plurality of heat exchangers are arranged in a plurality of consumer circuits, that the consumer circuits are supplied with energy by the central heating/cooling system or energy generator via a distributor, that the controller comprises a demand control, and that the controller is connected to the energy generator and the distributor via control lines.

BRIEF DESCRIPTION OF THE FIGURES

The invention is explained in greater detail below by means of exemplary embodiments with reference to the drawing. In the figures.

WAYS OF CARRYING OUT THE INVENTION

Figure 5:
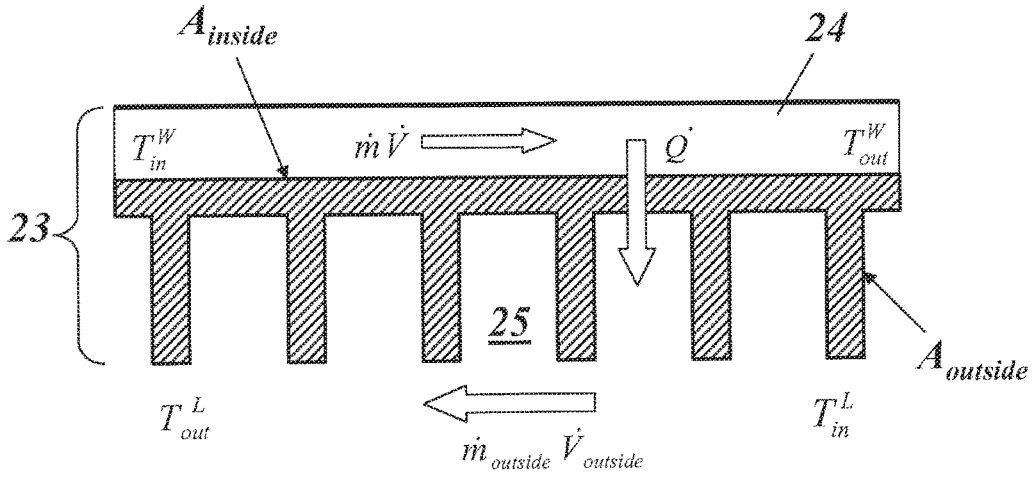
FIG. 5 shows a basic illustration of a heat exchanger operated in counterflow with the characteristic variables or parameters.

The present invention is based on considerations which relate to a model-like heat exchanger, as illustrated in FIG. 5. The heat exchanger 23 of FIG. 5 transfers a heat flow $\dot{Q}$ from a hydraulic side having a hydraulic channel 24 to an emission side 25 which, for example, is provided with ribs for increasing the emission surface and along which an inflow of a medium, in particular air, flows.

Water enters the hydraulic channel 24 from the left with a water inlet temperature $T_{in}^{W}$ and exits the hydraulic channel 24 again on the right with a water outlet temperature $T_{out}^{W}$. The water passes through the heat exchanger 23 with a mass flow $\dot{m}$ and a volume flow $\dot{V}$. The hydraulic channel 24 is provided with a surface $A_{inside}$ for the transfer of the heat flow $\dot{Q}$. On the emission side 25, the secondary medium (air) flows with an air inlet temperature $T_{in}^{L}$ the inlet side and an air outlet temperature $T_{out}^{L}$ at the outlet side and with a mass flow $\dot{m}_{outside}$ and a volume flow $\dot{V}_{outside}$ along a surface $A_{outside}$.

For the heat flow $\dot{Q}$ flowing from the hydraulic channel 24 to the emission side 25, the following equations (for a stationary state) are obtained:

$$\dot{Q}=\dot{m}\cdot c_p\cdot(T_{in}^{W}-T_{out}^{W}) \tag{1}$$

with the heat capacity $c_p$ on the hydraulic side (water).

$$\dot{Q}==\dot{m}_{outside}\cdot c_{p,outside}\cdot(T_{in}^{L}-T_{out}^{L}) \tag{2}$$

with the heat capacity $c_{p,outside}$ on the emission side (air).

$$\dot{Q}=\frac{k\cdot A_{inside}}{K^{n-1}}\cdot(\Delta T)^{n}\ \text{(K = unit Kelvin)} \tag{3}$$

with a heat transition coefficient k according to the following known equation $$k=\frac{1}{\frac{1}{\alpha_{inside}}+\frac{s\cdot A_{inside}}{\lambda\cdot A_{Material}}+\frac{A_{inside}}{\alpha_{outside}\cdot A_{outside}}}, \tag{4}$$

a ΔT according to the following known equation (logarithmic mean)

$$\Delta T=F\cdot\frac{(T_{in}^{W}-T_{out}^{L})-(T_{out}^{W}-T_{in}^{L})}{\ln\left(\frac{T_{in}^{W}-T_{out}^{L}}{T_{out}^{W}-T_{in}^{L}}\right)}\approx F\cdot\frac{T_{in}^{W}+T_{out}^{W}-T_{in}^{L}-T_{out}^{L}}{2} \tag{5}$$

(F=correction factor for taking account of the type of heat exchanger, i.e., concurrent, cross-flow, etc.) and a power n to be determined.

For the case n=1, these equations lead to the heat flow $\dot{Q}$:

$$\dot{Q}=\frac{T_{in}^{W}-T_{in}^{L}}{\frac{1}{k\cdot A\cdot F}+\frac{1}{2\cdot\dot{V}\cdot\rho\cdot c_p}+\frac{1}{2\cdot\dot{V}_{outside}\cdot\rho_{outside}\cdot c_{p,outside}}} \tag{6}$$

and to the maximum value $Q_{max}^{\&}$ asymptotically achieved for large volume flows $\dot{V}$:

$$\dot{Q}_{max}=\frac{T_{in}^{W}-T_{in}^{L}}{\frac{1}{k\cdot A\cdot F}+\frac{1}{2\cdot\dot{V}_{outside}\cdot\rho_{outside}\cdot c_{p,outside}}} \tag{7}$$

For the simplified case with n=1, the following simple relation is obtained for the ratio $Q^{\&}/Q_{max}^{\&}$, i.e., for the portion of the achieved saturation or the saturation level of the heat exchanger:

$$\frac{Q^{\&}}{Q_{max}^{\&}} = 1 - \frac{1}{2} \cdot \frac{T_{in}^{W} - T_{out}^{W}}{T_{in}^{W} - T_{in}^{L}} = f_1(T_{in}^{W}, T_{out}^{W}, T_{in}^{L}). \tag{8}$$

For a generalized case with a general n and a linearized equation (3), the following applies:

$$\frac{Q^{\&}}{Q_{max}^{\&}} = 1 - \frac{n}{2 \cdot (\Theta + n \cdot (1 - \Theta))} \cdot \frac{T_{in}^{W} - T_{out}^{W}}{T_{in}^{W} - T_{in}^{L}} = f_2(T_{in}^{W}, T_{out}^{W}, T_{in}^{L}) \tag{9}$$

with the dimensionless temperature difference 8 for describing the Taylor series, which is used for linearization and provides good accuracy with the constant value $\sigma=0.7$.

The two equations (8) and (9) can be replaced accordingly by a single equation of the form $$\frac{Q^{\&}}{Q_{max}^{\&}} = 1 - B\frac{T_{in}^{W} - T_{out}^{W}}{T_{in}^{W} - T_{in}^{L}} \tag{10}$$

with B depending on the type (but not the size) of the heat exchanger. For a pure counterflow heat exchanger, B=½ (see equation (8)); for a different heat exchanger, B can be determined with $$B = \frac{n}{2 \cdot (\Theta + n \cdot (1 - \Theta)} \tag{11}$$

Figure 2:
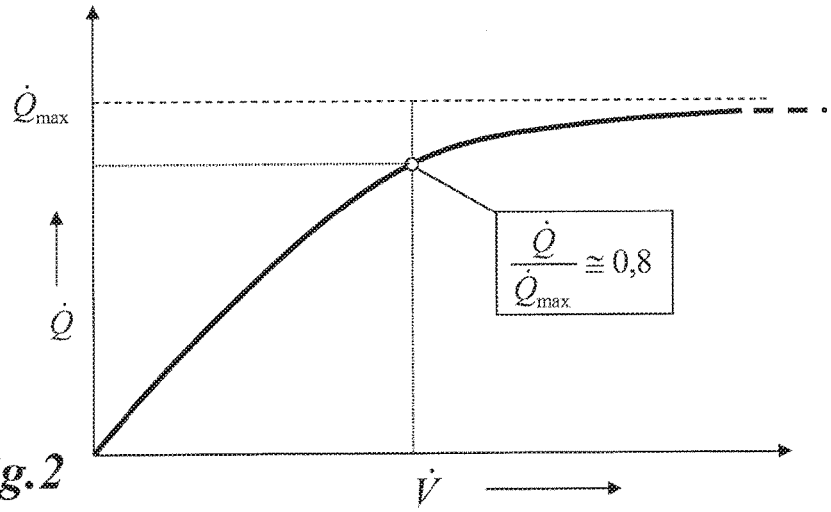
FIG. 2 shows an exemplary dependence of the heat flow transferred by a heat exchanger on the primary volume flow (for each heat exchanger, this dependence is a function of the operating point of the heat exchanger, in particular of the temperatures and the heat capacity flow (mass flow times heat capacity) on the secondary side)

It is essential for this result that under certain circumstances, the saturation level of the heat exchanger is a function of three temperatures, in the present case $T_{in}^{W}$, $T_{out}^{W}$, $T_{in}^{L}$, which can be measured in a comparatively simple manner. Thus, if the control of an HVAC installation is to be limited such that the volume flow on the primary side of the heat exchanger is limited upon reaching a predetermined saturation level $Q^{\&}/Q_{max}^{\&}$ (of, e.g., 0.8) in the heat exchanger, this can be performed based on a simple measurement of three temperatures (at the inlet and outlet on the primary side and at the inlet on the secondary side) of the heat exchanger, provided that the functional dependency of the saturation level on the temperatures is known. If the saturation level is known, it is then also possible to determine the corresponding volume flow from a (known) curve according to FIG. 2. Thus, the relatively laborious use and installation of a flowmeter on the primary side of the heat exchanger is not required. Nevertheless, such a flowmeter can optionally be used for calibration.

Figure 1:
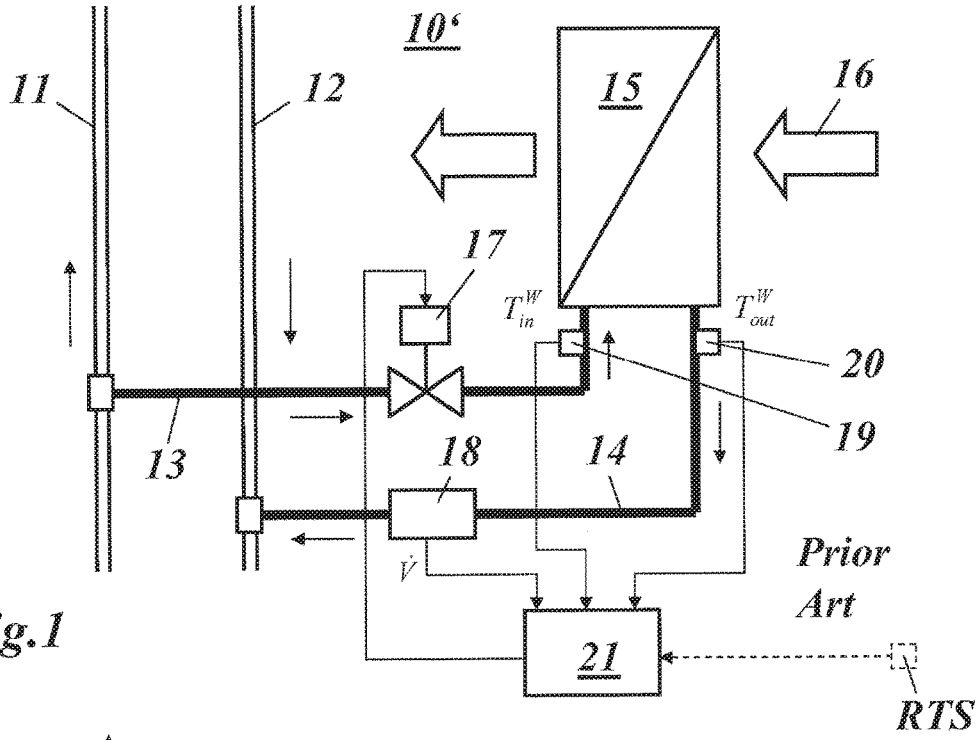
FIG. 1 shows a detail of a known HVAC installation having a heat exchanger and conventional devices for determining the emitted heat flow.
Figure 3:
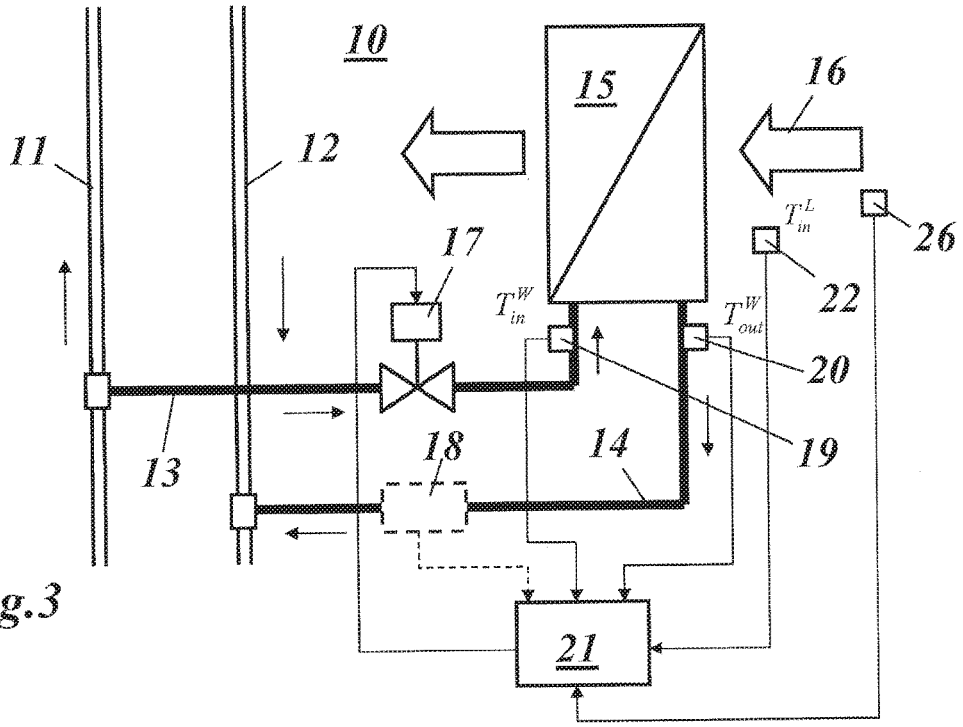
FIG. 3 shows in an illustration comparable to that of FIG. 1 an HVAC installation according to an exemplary embodiment of the invention.

FIG. 3 shows an illustration of HVAC installation according to an exemplary embodiment of the invention, which is comparable to that of FIG. 1. The HVAC installation 10 of FIG. 3 differs from the HVAC installation 10' of FIG. 1 in first instance in two substantial points: On the one hand, the use of a flowmeter 8 is not mandatory, but rather optional in order to be able to perform a calibration, if necessary. On the other hand, a third temperature sensor 22 is arranged at the heat exchanger's (15) inlet on the secondary side, said third temperature sensor being connected to a further input of the controller 21. In contrast to the room temperature sensor 27 in FIG. 1, the third temperature sensor 22 does not measure a room temperature, but instead the air inlet temperature $T_{in}^{L}$ of the air (air flow 16) flowing into the heat exchanger 15. It should be noted at this point that it is also possible, of course, to use a controllable pump or—if the heat transfer medium is gaseous—a blower (or an air flap) instead of the control valve 17 for influencing the volume flow on the primary side.

The controller 21 measures the three temperatures $T_{in}^{W}$, $T_{out}^{W}$, $T_{in}^{L}$ by means of the three temperature sensors 19, 20 and 22 and determines therefrom the current saturation level $$\frac{Q^{\&}}{Q_{max}^{\&}}$$

of the heat exchanger by means of a known functional dependency $$\frac{Q^{\&}}{Q_{max}^{\&}} = f(T_{in}^{W}, T_{out}^{W}, T_{in}^{L})$$

If this saturation level exceeds a predetermined limit value, which can be 0.8, for example, the volume flow $\dot{V}$ on the primary side of the heat exchanger 15 is limited, even if the control requests a larger volume flow due to changing room temperatures.

In the simplest case, determining the saturation level is performed in accordance with the above-mentioned equation (8). The above-mentioned equation (9) can be more suitable in other cases. Other functional dependencies are also conceivable within the scope of the invention.

If the optional flowmeter 18 is additionally installed, the heat flow can be determined in a conventional way, and thus an assumed functional dependency $$\frac{Q^{\&}}{Q_{max}^{\&}} = f(T_{in}^{W}, T_{out}^{W}, T_{in}^{L})$$

can be checked or calibrated. It is in particular conceivable that such a flow meter 18 is used only during the startup procedure of an installation and is omitted during later operation.

In another configuration of the method according to the invention, it is detected with the described method that the heat exchanger has exceeded a predetermined saturation level or is in saturation, thus, can no longer transfer heat. In this case, the system is informed that the flow temperature needs to be increased. This can be carried out by increasing the temperature of the central flow in the flow line 11. In circuits with constant volume flow, a special valve is located at each position where it is able to control the flow temperature of the consumer.

A special case occurs if an installation according to FIG. 3 is intended to cool an air flow 16 that contains moisture which condensates during cooling in the heat exchanger 15 and can be discharged as condensed water from the heat exchanger 15. This is in particular the case in tropical areas with high humidity where the installation can be used specifically for dehumidifying room air.

Figure 4:
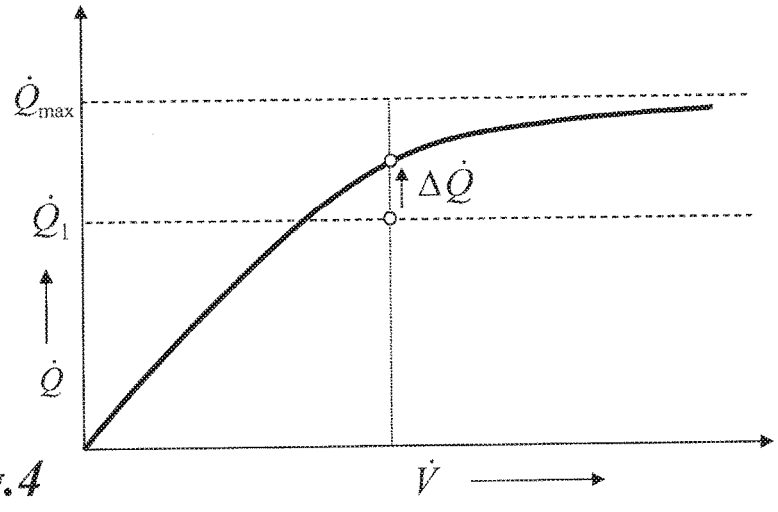
FIG. 4 shows in an illustration comparable to that of FIG. 2 the correction in the determination of the heat flow when humid air is cooled on the secondary side by means of the heat exchanger.

In this operating condition, a portion of the cold $\Delta\dot{Q}$ transferred to the air in the heat exchanger is used not for cooling the air, but instead for condensation of the moisture. The total cold flow is therefore larger and the limit value for associated volume flow on the primary side is therefore reached earlier than can be expected from the value of the cold flow for cooling the air ($\dot{Q}_1$ in FIG. 4) determined from the three temperatures. If this is to be taken into account, a correction can be made that also takes account of the moisture content of the air flowing through the heat exchanger 15. For this purpose, a humidity sensor 26 which measures the moisture content of the air and transmits the measured values to the controller 21 can be arranged according to FIG. 3 in the air flow 16. From the measured temperature values and the measured moisture content, the controller 21 then determines the cold flow $\Delta\dot{Q}$ which is needed exclusively for the condensation and has to be added to the value ($\dot{Q}_1$ in FIG. 4) that is required for cooling the air so as to determine the correct associated volume flow according to the curve from FIG. 4. A limit value for the volume flow in the case of condensation thus is reached earlier than without condensation.

Figure 6:
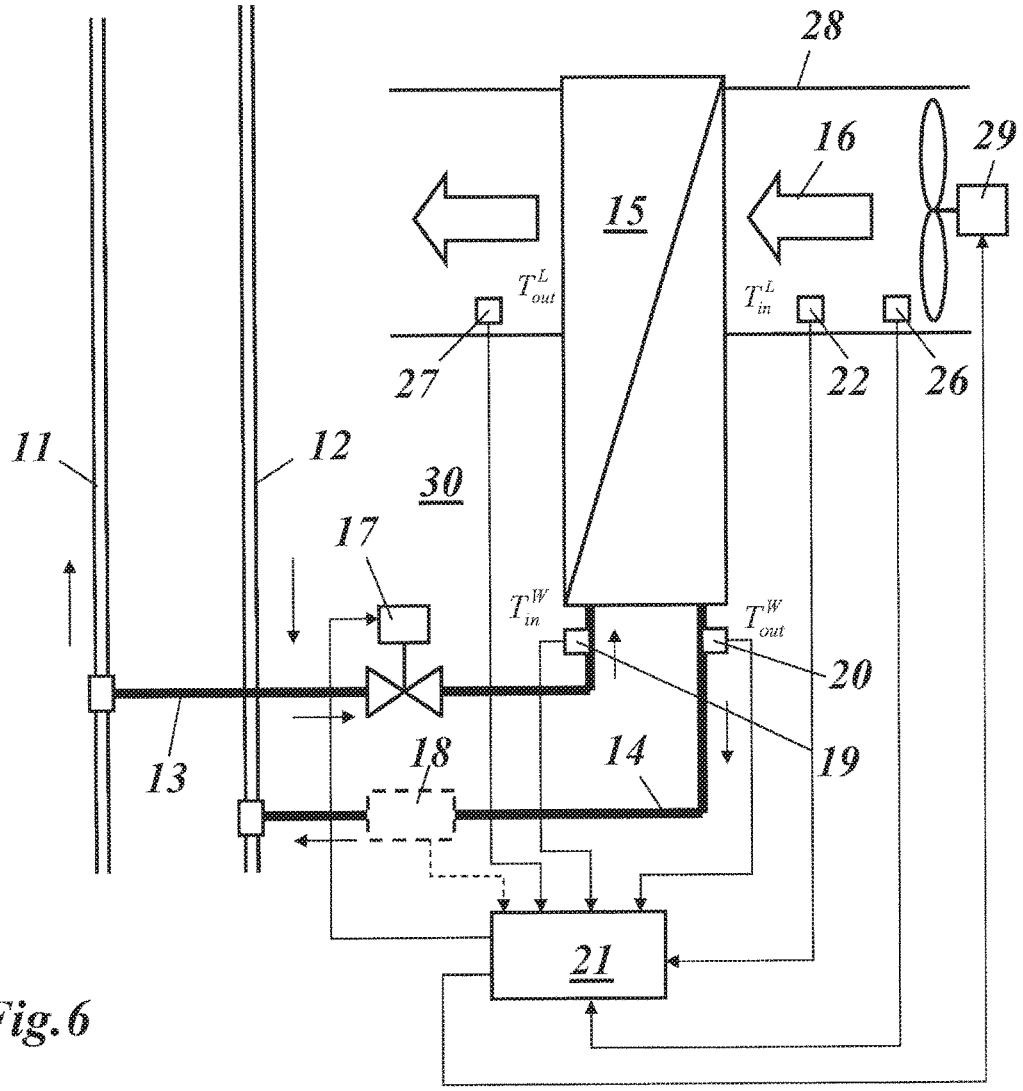
FIG. 6 shows in an illustration comparable to FIG. 3 an HVAC illustration according to another exemplary embodiment of the invention.

Another possibility of operation in an HVAC installation 30 according to FIG. 6 is to measure the inlet temperature $T_{in}^{L}$ and the outlet temperature $T_{out}^{L}$ of the air in the air flow 16 on the secondary side of the heat exchanger 15 by means of the temperature sensors 22 and 27 and to use these measurements (analogously to the way described above) in connection with a temperature measurement on the primary side for deriving the heat exchanger's 15 saturation level, which depends on the volume flow on the secondary side, and therefore for deriving the volume flow on the secondary side (the heat exchanger 15 is viewed, as it were, in the opposite direction).

This variable can then be used to intervene in the volume flow on the secondary side of the heat exchanger 15 in a controlling or limiting manner. This can be carried out by means of a blower 29 which is controlled by the controller 21 and is arranged in an air duct 28 that leads to the heat exchanger 15 (or away from the heat exchanger 15). However, instead of the blower, a controllable air flap or—if the secondary medium is liquid, for example—a pump or a control valve can also be provided as a control means.

Such a control is particularly advantageous if—as it is often the case—a temperature sensor 27 is already installed at the outlet on the secondary side of the heat exchanger 15 in an HVAC installation.

However, it is principally also conceivable within the scope of the invention to measure only the temperatures $T_{in}^{W}$, $T_{out}^{W}$ and $T_{out}^{L}$ and to use them for controlling in the heat exchanger operation.

The present invention can be advantageously used in HVAC installations which comprise a so-called demand control and which become increasingly important with respect to increased energy efficiency.

Figure 7:
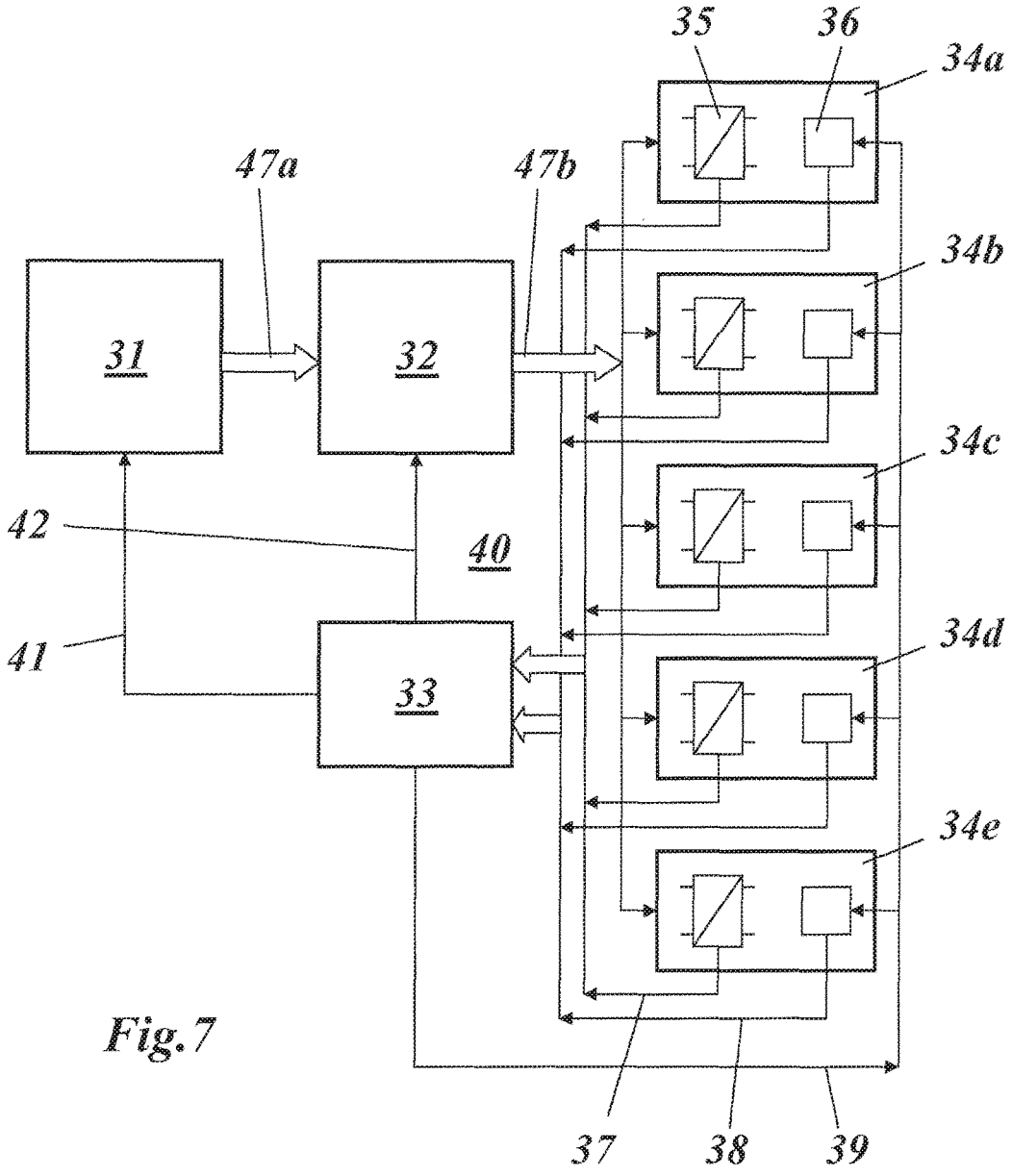
FIG. 7 shows the basic circuit diagram of an exemplary HVAC installation having a plurality of consumer circuits and a demand control which is suitable for the use of the invention.

FIG. 7 shows in a schematic illustration the exemplary structure of an HVAC installation 40 with demand control. In the example, the HVAC installation 40 comprises five consumer circuits 34*a-e* which are supplied with heat and/or cold energy by a central energy generator 31 via a distributor 32 and the corresponding supply lines 47*a, b*. A heat exchanger 35 which transmits the fed energy to a consumer 36 is arranged in each of the individual consumer circuits 34*a-e*.

Providing the energy by the energy generator 31 and distributing the energy by the distributor 32 is controlled by a demand control 33 via corresponding control lines 41 and 42. Moreover, the demand control 33 can intervene in a controlling manner in the individual consumer circuits 34*a-e* on the consumer side via corresponding control lines 39 in order to change the volume flow on the secondary side in the respective heat exchanger 35, for example.

The demand control 33 receives demand signals from the consumer circuits 34*a-e* via demand signal lines 38 in order to control the generation and distribution of energy in such a manner that the requested demand is covered in a way that is optimized according to predetermined criteria such as, e.g., energy efficiency.

For this optimization, information about the respective operating state of the heat exchangers 35 is needed, namely the inlet and outlet temperatures, the saturation level, the volume flows on the primary and secondary sides and—if air is used as the medium—the moisture content of the air.

According to the invention, this information can be derived from simple temperature and, optionally, humidity measurements without having to use complicated flowmeters. Accordingly, temperature values from the heat exchanger 35 are transmitted to the demand control 33 via temperature signal lines 37 (a signal line for the moisture measurement is not illustrated in FIG. 7).

Figure 8:
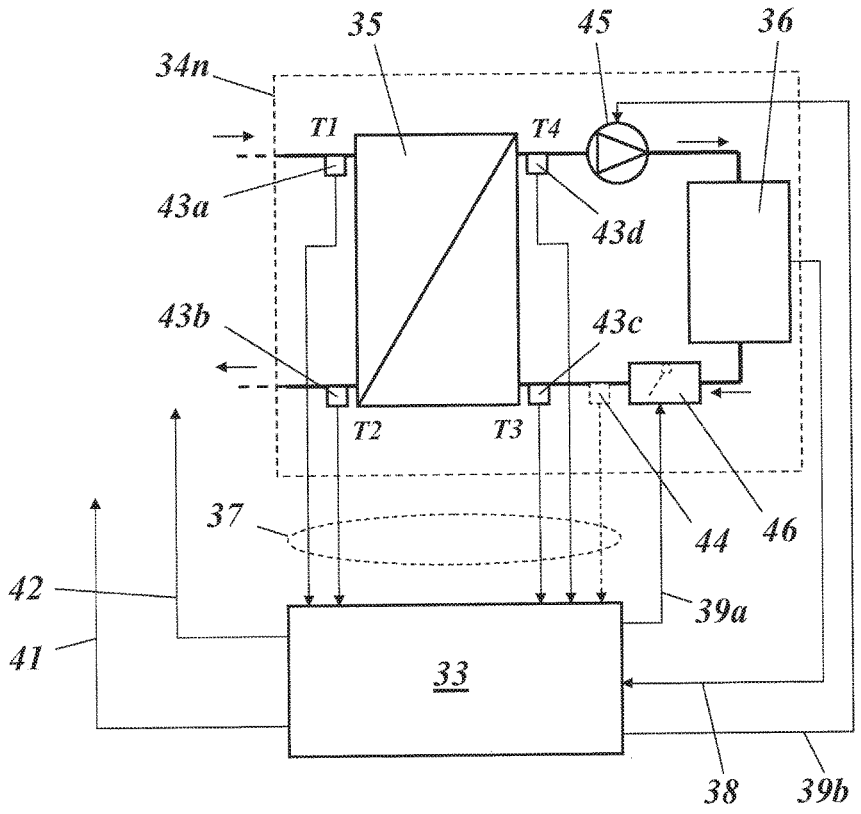
FIG. 8 shows the interaction of demand control and consumer circuit in an installation according to FIG. 7, according to an exemplary embodiment of the invention.

The structure in the individual consumer circuit 34*n* is illustrated in FIG. 8. The inlet and outlet temperatures T1, T3 and T2, T4 are measured on the primary and secondary sides by means of the temperature sensors 43*a-d* and, optionally, the relative humidity is measured with a humidity sensor 44. The secondary medium flows through the consumer 36 arranged on the secondary side of the heat exchanger 35 and is moved in a circuit by means of a feed device 45 such as, for example, a pump, a blower or the like. The volume flow of the secondary medium can be influenced either via the feed device 45 or via separate control means 46, a valve, a flap or the like. A demand signal is output from the consumer 36 itself and is transmitted to the demand control 33 via the demand signal line 38.

According to the invention, the saturation level of the heat exchanger 35 as well as the volume flows can be determined from the measured temperatures T1-T4. If the optimization requires intervention of the demand control 33 on the secondary side, this can be carried out by means of the control lines 39*a, b* via the feed device 45 and/or the control means 46.

If the optimization requires intervention of the demand control in the distributor 32, this can be carried out via the control line 42. Intervention in the energy generator 31 is performed via the control line 41. Such an intervention can include changing the flow temperature, for example. However, it is also conceivable to change the overall energy generation in stages if a plurality of similar modules in the energy generator (e.g. refrigerating machines) operate simultaneously and can be activated individually, as disclosed in the printed publication U.S. Pat. No. 7,377,450 B2, for example.

REFERENCE LIST

10, 10', 30 HVAC installation
11 flow line
12 return line
13 flow branch line
14 return branch line
15, 23 heat exchanger

16 air flow
17 control valve
18 flowmeter
19, 20 temperature sensor
21 controller
22, 27 temperature sensor
24 hydraulic channel
25 emission side
26 humidity sensor
28 air duct
29 blower (ventilator)
31 energy generator (heat/cold energy)
32 distributor
33 demand control
34*a-e,n* consumer circuit
35 heat exchanger
36 consumer
37 temperature signal line
38 demand signal line
39, 41, 42 control line
39*a,b* control line
40 HVAC installation
43*a-d* temperature sensor
44 humidity sensor
45 feed device (e.g. pump, blower, etc.)
46 control means (e.g. valve, flap, etc.)
47*a, b* supply line
RTS room temperature sensor
$\dot{Q}$ heat flow
$\dot{Q}_{max}$ max. heat flow (at saturation)
$\Delta\dot{Q}$ condensation cold flow
$\dot{V}$ volume flow (water)
$T_{in}{}^{W}$ water inlet temperature
$T_{out}{}^{W}$ water outlet temperature
$T_{in}{}^{L}$ air inlet temperature
$T_{out}{}^{L}$ air outlet temperature
T1-T4 temperature

What is claimed is:

1. An HVAC installation comprising at least one heat exchanger which is connected on a primary side to a flow line and a return line of a central heating/cooling system that operates with a first heat transfer medium and through which a secondary medium flows on a secondary side, and further comprising a control means for controlling a mass flow of the first heat transfer medium on the primary side and/or for controlling a flow of the second heat transfer medium on the secondary side, as well as a first temperature sensor for measuring a first temperature (T1, $T_{ein}{}^{W}$) of the first heat transfer medium entering the heat exchanger, a second temperature sensor for measuring a second temperature (T2, $T_{aus}{}^{W}$) of the first heat transfer medium exiting the heat exchanger, and a controller to which the first and second temperature sensors are connected on an inlet side, and which is connected on an outlet side to the control means, wherein at least one third temperature sensor for measuring a third temperature (T3, $T_{ein}{}^{L}$) and/or a fourth temperature (T4, $T_{aus}{}^{L}$) of the secondary medium entering on the secondary side into the heat exchanger with a third temperature (T3, $T_{ein}{}^{L}$) and exiting the heat exchanger with a fourth temperature (T4, $T_{aus}{}^{L}$) is provided, the third temperature sensor is connected to an input of the controller, and the controller is designed such that it controls the control means in accordance with the temperature values measured by the at least three temperature sensors and determines a saturation level $$\left(\frac{\dot{Q}}{\dot{Q}_{max}}\right)$$

of the heat exchanger from the temperature values measured by said at least three temperature sensors for controlling the operation of the heat exchanger.

2. The HVAC installation according to claim 1, characterized in that a consumer is connected on the secondary side to the heat exchanger, and that the controller receives demand signals from the consumer via a demand signal line.

3. The HVAC installation according to claim 1, characterized in that the heat transfer medium is water and the secondary medium is air.

4. The HVAC installation according to claim 3, characterized in that the control means is a blower which is installed in an air duct that leads to the secondary side of the heat exchanger.

5. The HVAC installation according to claim 3, characterized in that a humidity sensor for measuring the moisture content of the air flowing into the heat exchanger is provided, and that the humidity sensor is connected to an input of the controller.

6. The HVAC installation according to claim 1, characterized in that the control means is a control valve which is installed in a flow branch line or return branch line that leads to the primary side of the heat exchanger.

7. The HVAC installation according to claim 1, characterized in that a flowmeter is provided which is installed in flow branch line or return branch line that leads to the primary side of the heat exchanger, and that the flowmeter is connected to an input of the controller.

8. The HVAC installation according to claim 1, characterized in that a plurality of heat exchangers are arranged in a plurality of consumer circuits that the consumer circuits are supplied with energy by the central heating/cooling system or energy generator via a distributor, that the controller comprises a demand control, and that the controller is connected to the energy generator and the distributor via control lines.

* * * * *